US005562955A

United States Patent [19]

Kam

[11] Patent Number: 5,562,955

[45] Date of Patent: Oct. 8, 1996

[54] DECORATIVE PIECE OF FURNITURE AND METHOD OF MAKING

[75] Inventor: Siu T. Kam, Dallas, Tex.

[73] Assignee: Chinese Art Gallery, Inc., Dallas, Tex.

[21] Appl. No.: 414,614

[22] Filed: Mar. 31, 1995

[51] Int. Cl.[6] ..... B44C 1/14

[52] U.S. Cl. ..... 428/14; 156/63; 428/152

[58] Field of Search ..... 428/14, 152; 156/63

[56] References Cited

U.S. PATENT DOCUMENTS 3,546,038 12/1970 Smith ..... 428/83 X 3,782,495 1/1974 Nassof ..... 428/152 X

*Primary Examiner*—Henry F. Epstein

*Attorney, Agent, or Firm*—Harry C. Post, III

[57] ABSTRACT

A decorative piece of furniture is made from a frame. A cover is attached to the frame. A decorative scene is disposed on a side of the cover to be viewed. The cover includes a plurality of wrinkled metal foil parts. Each of the plurality of wrinkled metal foil parts has a front and a back. A thin, flexible material is connected to the back of each of the plurality of metal foil parts. The decorative scene is disposed on the fronts of the plurality of metal foil parts.

A method of making a piece of decorative furniture that embodies a plurality of metal foil parts backed with a thin, flexible material. A thin, flexible material of each metal foil part is secured to a second thin, flexible material. Paint is .applied to the metal foil parts to provide a decorative scene. The painted metal foil parts and the second thin, flexible material are damaged to create a distressed and wrinkled decorative scene. The second thin, flexible material is secured to a frame.

17 Claims, 2 Drawing Sheets

DECORATIVE PIECE OF FURNITURE AND METHOD OF MAKING

TECHNICAL FIELD

This invention relates to a decorative piece of furniture and a method of making and, more particularly, to a decorative piece of furniture, such as a screen or trunk, having the appearance of an antique, the screen may be folded, and a method of making such screens.

BACKGROUND ART

It is well known that screens have been used for many years as a portable apparatus to separate, conceal, shelter or protect. These portable screens have a light, movable, covered frame or series of frames hinged together. Frequently, such screens and other pieces of furniture, such as a trunk, have a decorative scene drawn or painted on the cover. Such decorative furniture becomes even more desirable when it is an antique. However, an antique decorative piece of furniture, such as a screen or trunk, is not normally used for the above stated purposes because of the possibility of damage to it and the resulting loss of value.

Accordingly, it is an object of the present invention to provide a decorative piece of furniture; specifically, a screen or trunk, that appears to be an antique.

Further, it is an object of the present invention to provide a method of making a decorative piece of furniture; specifically, a screen or trunk, that appears to be an antique.

DISCLOSURE OF THE INVENTION

In accordance with the present invention, there is provided a decorative piece of furniture that is made from a frame and a cover attached to the frame. A decorative scene is disposed on a side of the cover to be viewed. The cover includes a plurality of wrinkled metal foil parts. Each of the plurality of wrinkled metal foil parts has a front and a back. A thin, flexible material is connected to the back of each of the plurality of metal foil parts. The decorative scene is disposed on the fronts of the plurality of metal foil parts.

Further, in accordance with the present invention there is provided a decorative screen made from a series of frames and a cover attached to the series of frames. A decorative scene is provided on a side of the cover to be viewed. The cover includes a plurality of wrinkled metal foil parts. Each of the plurality of wrinkled metal foil parts has a front and a back. A thin, flexible material is connected to the back of each of the plurality of metal foil parts and the decorative scene is disposed on the fronts of the plurality of metal foil parts.

Further, in accordance with the present invention there is provided a method of making a decorative piece of furniture. The screen embodies a plurality of metal foil parts backed with a thin, flexible material. The thin, flexible material of each metal foil part is secured to a second thin, flexible material. Paint is applied to the metal foil parts to provide a decorative scene. The painted metal foil parts and the second thin, flexible material are damaged to create a distressed and wrinkled decorative scene. The second thin, flexible material is secured to a frame.

Further, in accordance with the present invention there is provided a method of making a decorative screen. The screen embodies a plurality of metal foil parts backed with a thin, flexible material. The thin, flexible material of each metal foil part is glued to a second thin, flexible material.

The metal foil parts are painted to provide a decorative scene divided into component parts for each panel in a series of panels. The painted metal foil parts glued to the second thin, flexible material are damaged. Each of the component parts of the decorative scene are aligned on the respective panel in the series of panels. The second thin, flexible material of each component part of the scene is glued to the respective panel in the series of panels. The series of panels are pivotally connected with one another with the component parts of the scene aligned.

BRIEF DESCRIPTION OF THE DRAWINGS

Other objects and advantages of the invention will become apparent upon reading the following detailed description and upon reference to the drawings, wherein like reference characters are used throughout to designate like parts.

BEST MODE FOR CARRYING OUT THE INVENTION

Figure 1:
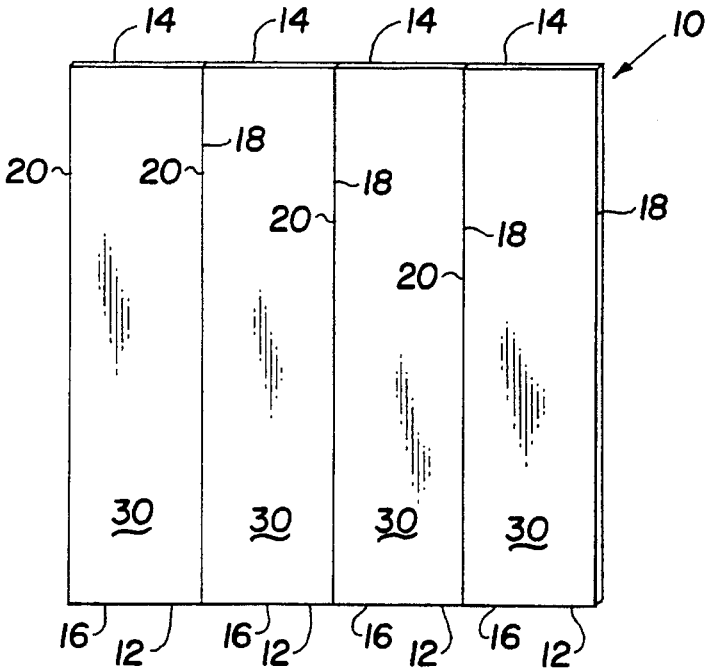
FIG. 1 is an elevational view of a screen having four panels and constructed according to the present invention.
Figure 2:
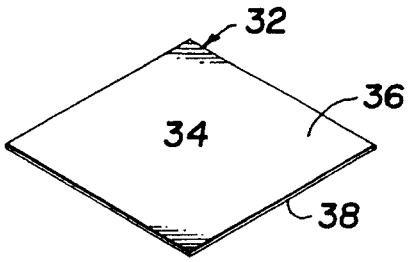
FIG. 2 is an enlarged, perspective view of a part of the invention shown in FIG. 1.
Figure 5:
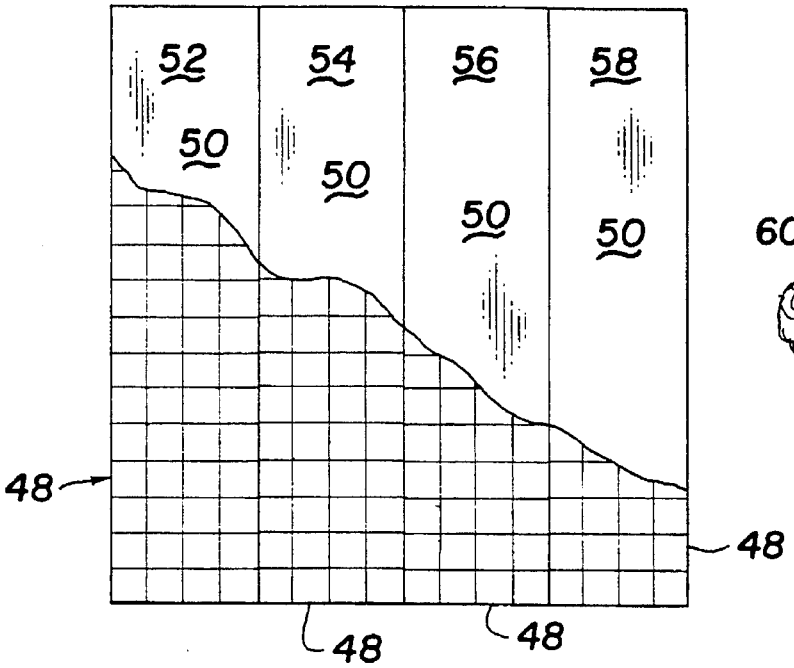
FIG. 5 is an elevational view of four of the portions shown in FIG. 3 while a decorative scene is being painted on the four portions.
Figure 8:
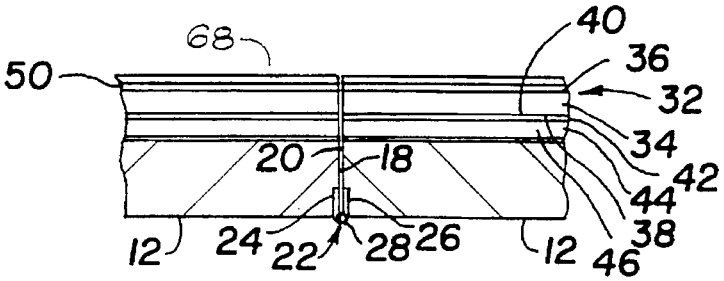
FIG. 8 is a plan view of a portion of two of the panels shown in FIG. 1.

Now turning to FIGS. 1, 5 and 8, there is shown a decorative screen 10 constructed according to the present invention. Screen 10 is composed of one or a series of frames or panels 12. Although screen 10 is shown having four panels 12, a screen may be made with as few as one frame and with six or more frames.

Each frame 12 has a rectangular shape with a top 16, a bottom 18, and right and left sides 20 and 22, respectively. Frames 12 are made from a conventional material, such as ply wood, with a thickness of ¾ or 1 inch. As a rule, each frame 12 has a size of about 84"×16" (213.36 cm×40.64 cm) or 48"×16" (121.92 cm×40.64 cm).

Frames 12 are connected to one another by a plurality of hinges 22, which are of conventional construction. Each hinge 22 has a right flange 24 connected to right side 20 of a first frame 12 and a left flange 26 connected to left side 22 of a second frame 12. Right flange 24 and left flange 26 are pivotally connected to one another by a pin 28.

As best seen in FIGS. 2–4 and 8, a cover 30 is attached to each frame 12. Cover 30 is constructed from a plurality of metal foil parts 32, such as that provided by squares of about 4×4 inches (10.16×10.16 cm). Each foil part 32 is made of a metal, such as tin or pewter, hammered into a foil 34 with a front 36 and a back 38. Back 38 of metal foil 34 is secured, such as by glue or paste 40, to a thin, flexible material 42, such as very light paper with a thickness of no more than onion skin paper.

Figure 4:
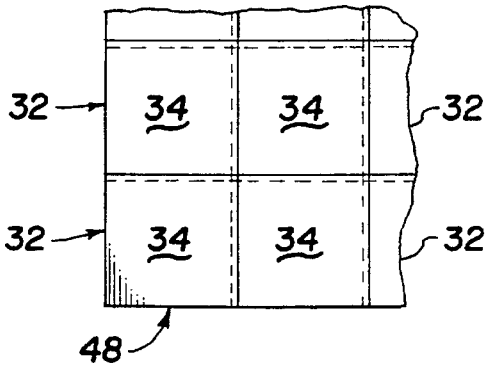
FIG. 4 is an enlarged elevational view of several parts shown in FIG. 3 illustrating the positioning on the part shown in FIG. 2.
Figure 3:
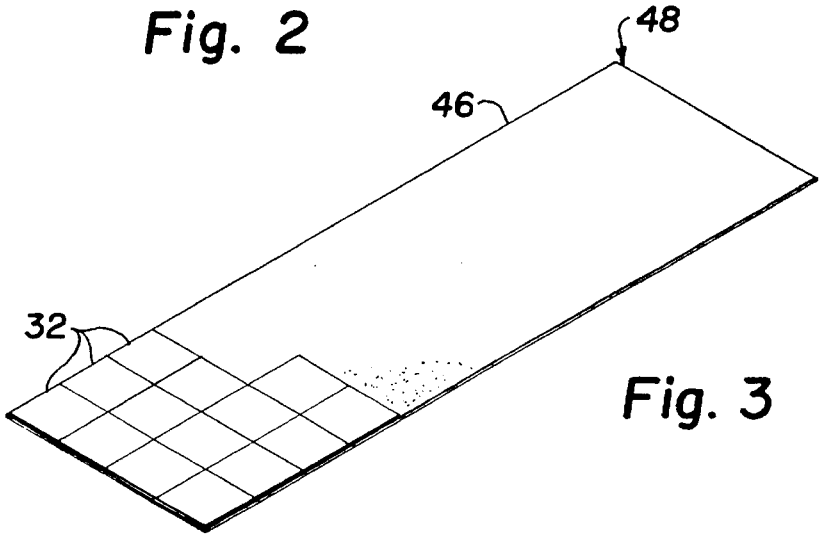
FIG. 3 is a perspective view of another part of the screen shown in FIG. 1 using the part shown in FIG. 2.

Each metal foil part 32 is secured, such as by glue or paste 44, in an overlapping configuration (as best seen in FIGS. 3 and 4) to a thin, flexible material 46 to form a cover base 48. To provide a more antique appearance, it is preferred that glue or paste 40 is a paste made from a mixture of flour and water. Material 46 has a length that is longer (100 inches, 254 cm) and a width (18 inches, 45.72 cm) that is wider than frame 12. Although material 46 is a thin, flexible material, it is stronger and thicker (200 pound paper) than thin, flexible material 42. Each cover base 48 is dried for a period of time sufficient to insure that metal foil parts 32 are secured to material 46.

As shown in FIG. 5, a cover base 48 is used for each frame 12. Since a series of four frames 12 are being used in screen 10, four cover bases 48 are necessary. Cover bases 48 are supported adjacent to one another and a decorative scene 50 is painted over fronts 36 of metal foil parts 32.

Figure 6:
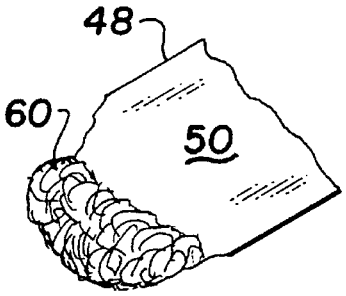
FIG. 6 is a perspective view of one of the several portions shown in FIG. 3 after the paint is dried and when being distressed.
Figure 7:
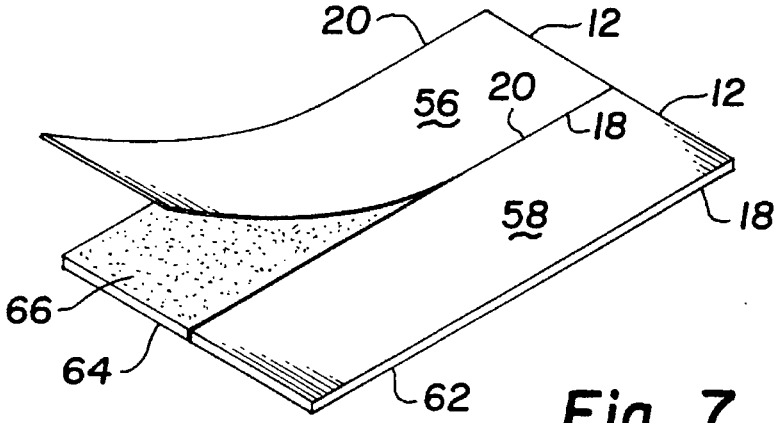
FIG. 7 is a perspective view of two of the portions shown in FIG. 5 after being distressed, one portion attached to a panel and the other being aligned while attaching it to another panel.

After the paint in each component part 52, 54, 56 and 58 of decorative scene 50 used on each cover base 48 is allowed to completely dry, each cover base 48 is, as shown in FIG. 6, distressed to form a wad 60. Each cover base 48 is distressed by hand to cause the paint in decorative scene 50 to be cracked and metal foils 34 to be wrinkled. Although decorative scene 50 may be painted with any conventional paint, the preferred paint is water based acrylic So that large cracks are formed when cover base 48 is distressed or wadded.

The edges of component 58 are folded to extend behind cover 30 or are removed, such as by cutting, to form edges that are generally aligned with edges 18 and 20 of each frame 12. After the edges are aligned, component 58 is secured, such as by glue or paste, to a back support 62, which is preferably a panel of plywood with a thickness of about ¾ inch. A back support panel 64 of a similar material is then disposed adjacent to back support 62 with its front being coated with glue or paste 66. The edges of component 56 are folded to extend behind cover 30 or removed, such as by cutting, to form edges that are generally aligned with edges 18 and 20 of each frame 12. Component 56 is then moved toward top 14 or bottom 16 to align the scenes of cover 30 on component 56 with that on component 58. After being aligned, component 56 is pressed against glue or paste 66 to secure the component to back support 62. By aligning and connecting components 54 and 52 to the respective panel 12, decorative scene 50 is formed across frames 12.

After the middle two frames 12 are aligned with one another, these frames 12 are fastened to one another, as shown in FIG. 8, by upper and lower hinges 22. To fasten the end frames 12 to the middle frames 12, the end frames 12 are fastened to one another by upper and lower hinges 22 with flanges 24 and 26 facing away from cover 30 and pin 28 facing cover 30.

To further enhance the antique appearance, a coating 68 is applied to the exterior of each frame 12. Coating 68 is formed by allowing an antique finish solution to dry. The antique finish solution is a mixture of about nine pints of turpentine, about one pint of oil based varnish, and about three teaspoons of acrylic dye, two teaspoons being brown and one teaspoon being black.

The invention having been described, what is claimed is:

1. A decorative piece of furniture, comprising: a frame; a cover attached to said frame; and a decorative scene disposed on a side of the cover to be viewed; said cover including a plurality of wrinkled metal foil parts disposed on the side of the cover to be viewed, each of the plurality of wrinkled metal foil parts having a front and a back, a thin, flexible material connected to the back of each of the plurality of metal foil parts, and the decorative scene disposed on the fronts of the plurality of metal foil parts.

2. A piece of furniture as set forth in claim 1, further comprising: a coating of material applied to said cover to provide an antique appearance.

3. A piece of furniture as set forth in claim 1, further comprising: the thin, flexible material connected to the backs of the plurality of wrinkled metal foil parts being connected to a second thin, flexible material.

4. A piece of furniture as set forth in claim 3, further comprising: the second thin, flexible material being connected to said frame.

5. A piece of furniture as set forth in claim 4, further comprising: a coating of material applied to said cover to provide an antique appearance.

6. A decorative screen, comprising: a series of frames; a cover attached to said series of said frames; and a decorative scene disposed on a side of the cover to be viewed; said cover including a plurality of wrinkled metal foil parts disposed on the side of the cover to be viewed, each of the plurality of wrinkled metal foil parts having a front and a back, a thin, flexible material connected to the back of each of the plurality of metal foil parts, and the decorative scene disposed on the fronts of the plurality of metal foil parts.

7. A screen as set forth in claim 6, further comprising: hinge means pivotally connecting said series of frames to one another.

8. A screen as set forth in claim 6, further comprising: a coating of material applied to said cover to provide an antique appearance.

9. A screen as set forth in claim 6, further comprising: the thin, flexible material connected to the backs of the plurality of wrinkled metal foil parts being connected to a second thin, flexible material.

10. A screen as set forth in claim 9, further comprising: the second thin, flexible material being connected to each of the frames in said series of frames.

11. A screen as set forth in claim 10, further comprising: hinge means pivotally connecting said series of frames to one another.

12. A screen as set forth in claim 11, further comprising: a coating of material applied to said cover to provide an antique appearance.

13. A method of making a decorative piece of furniture, comprising the steps of: providing a plurality of metal foil parts backed with a thin, flexible material; securing the thin, flexible material of each metal foil part to a second thin, flexible material; applying paint to the metal foil parts to provide a decorative scene; damaging the painted metal foil parts and the second thin, flexible material to create a distressed and wrinkled decorative scene; and securing the second thin, flexible material to a frame.

14. A method as set forth in claim 13, further comprising the step of: applying a coat of material simulating an antique finish over the decorative scene and frame.

15. A method of making a decorative screen, comprising the steps of: providing a plurality of metal foil parts backed with a thin, flexible material; securing the thin, flexible material of each metal foil part to a second thin, flexible material; applying paint to the metal foil parts to provide a decorative scene divided into component parts for each respective frame in a series of frames; damaging the painted metal foil parts and the second thin, flexible material to create a distressed and wrinkled decorative scene; aligning each of the component parts of the decorative scene on the respective frame in the series of frames; securing the second thin, flexible material of each component part of the scene to the respective frame in the series of frames; and pivotally connecting the series of frames to one another.

16. A method as set forth in claim 15, further comprising the step of: applying a coat of material simulating an antique finish over the decorative scene and frames.

17. A method as set forth in claim 16, further comprising the step of: positioning the series of frames on the respective component parts of the scene to be aligned before pivotally connecting the series of frames to one another.

* * * * *